United States Patent [19]

Pizzoni et al.

[11] Patent Number: 4,575,413

[45] Date of Patent: Mar. 11, 1986

[54] ALUMINUM STEARATE AND/OR ACETATE ANTIFOULANTS FOR REFINERY OPERATIONS

[75] Inventors: Vincenzo M. P. Pizzoni, Woking; Sukhjit S. Randhawa, Guildford, both of England

[73] Assignee: Exxon Research & Engineering Co., Florham Park, N.J.

[21] Appl. No.: 752,414

[22] Filed: Jul. 5, 1985

[30] Foreign Application Priority Data

Jul. 6, 1984 [GB] United Kingdom ..... 8417320

[51] Int. Cl.[4] ..... C10G 9/16

[52] U.S. Cl. ..... 208/48 AA; 208/130; 585/950

[58] Field of Search ..... 208/48 AA, 48 R, 130, 208/47; 585/950

[56] References Cited

U.S. PATENT DOCUMENTS

| | | | |
|---|---|---|---|
| 4,259,175 | 3/1981 | McArthur | 208/48 AA |
| 4,271,008 | 6/1981 | Vogt et al. | 585/950 |
| 4,318,799 | 3/1982 | Yoo | 208/48 R |
| 4,532,109 | 7/1985 | Maeda et al. | 208/48 R |

*Primary Examiner*—John Doll
*Assistant Examiner*—Lance Johnson
*Attorney, Agent, or Firm*—M. J. Dew; R. L. Graham

[57] ABSTRACT

Fouling of tubes carrying refinery and petrochemical process streams, especially at high operating temperatures, is reduced by introducing aluminum stearate or aluminum acetate into the stream.

18 Claims, No Drawings

ALUMINUM STEARATE AND/OR ACETATE ANTIFOULANTS FOR REFINERY OPERATIONS

This invention relates to the reduction of fouling in tubes carrying refinery and petrochemical process streams, and is particularly but not exclusively concerned with the reduction of fouling occurring in high temperature processes.

Fouling of tubes and equipment carrying refinery and petrochemical process streams is a general problem which has great impact on process economics. In the refinery and petrochemical industry, it is becoming more common to process feed stocks which are heavy in nature, such as atmospheric pipestill residuum, catalytic cracker residuum and vacuum distillation residuum. For example, the technique of viscosity breaking (visbreaking) is a residuum conversion process based on mild thermal cracking, which is employed primarily to produce incremental gasoline and middle distillate fuels and to reduce fuel oil viscosity.

The treatment of heavier feed stocks by thermal or other chemical processes inevitably leads to fouling of the equipment used. Antifoulants are therefore an important part of the conversion process techniques, and a reduction in tube fouling leads to the advantages of increased run length for the same conversion; increased conversion for the same run length; minimised furnace energy requirements; extended cleaning cycles; and reduced feed preheat losses.

Taking visbreaker operation as an example, maximum conversion of feed stock is limited by product quality, furnace coil coking and heat exchanger fouling. Visbreaker operation, as well as converting the feed stream, results in the formation of visbreaker tar which generally includes high levels of asphaltenes which under certain conditions precipitate out of the stream. Thus asphaltene content in the visbreaker is increased by upstream polymerisation and condensation reactions, and high asphaltene concentrations lead to deposition on the tar-side of visbreaker heat exchanger tubes, although there is believed to be some chemical reaction fouling as well. Coke laydown, of course, occurs in the furnace region of the visbreaker.

The mechanisms for coking or fouling in visbreakers and other refinery or petrochemical process equipment are thought to include direct thermal cracking to coke; aromatic condensation to asphaltenes followed by coke laydown after long periods at high temperatures; autoxidation polymerisation by free radical reactions; and dehydrogenation of saturated hydrocarbons to unsaturates, followed by polymerisation which contributes to gum formation and ultimately degradation to coke.

It is known to modify the surface of petrochemical process tubes in a pre-treatment step. For example EP 110486 discloses the coating of shell and tube heat exchanger surfaces with an inert layer which is impermeable to the reactor effluent cooled in the exchanger. The coating is carried out before use for example by applying to the tube a mixture of the inert material (graphite, metal or metal oxide) with a silicone based resin in an aromatic solvent, followed by curing to vaporize the solvent. Alternatively ethylene quench oil and peroxide can be applied to the tube wall, followed by thermosetting.

It is also known to promote antifouling of process streams by injecting into such streams organic anti-fouling additives, the principal components of which are dispersants but which may additionally contain minor quantities of antioxidant. It is believed that these additives act by slowing down the fouling reaction rate and dispersing any deposit-forming species present in the stream. However because these known antifoulants are organic molecules, their effectiveness in reducing fouling or coking in high temperature process streams, for example those in excess of 400° C., is considerably limited by virtue of the thermal cracking of their active components. This is particularly so in the case of the antifouling effect produced in visbreakers and delayed cokers.

The effectiveness of an antifoulant additive in a process stream may be demonstrated on a laboratory scale by a so called thermal fouling tester. Such a tester can simulate both refinery furnace heater tube fouling and also downstream heat exchanger fouling. The rate of fouling can be determined by a temperature rise or pressure drop technique. Thus, very simply, the process stream to be tested is allowed to flow through a carrier tube at controlled conditions, and at one position passes over i.e. around an electrically heated carbon steel tube which is contained within the carrier tube at that position. The input temperature of the stream into the test equipment is fixed, and the energy input to the tube is controlled, so as to give a constant preset stream temperature at the outlet of the test equipment. The tube temperature necessary to maintain this constant stream outlet temperature increases as the tube fouls, and this temperature rise (requiring an increase in the energy input to the heated tube) is taken as a measure of the fouling rate produced by the stream. The pressure drop technique requires the process stream under test to enter the tester carrier tube at a constant temperature, and the stream is cooled to a preset constant stream temperature at the tester outlet, after passage over the heated tube. During the cooling, any precipitate formed is trapped on an appropriate filter, and build up of fouling debris on the filter leads to plugging and hence an increase in pressure drop. The pressure drop is taken as a measure of the fouling rate. Such testing is of course comparative, but it has been demonstrated to give consistent results, and so enables a comparison of untreated and antifoulant treated streams. Generally, test conditions are selected to simulate refinery conditions.

Hitherto it has been unsuspected that good antifoulant activity at high temperatures could be obtained by an additive technique. It will be appreciated that pretreatment of tubes is impractical in a refinery situation. Thus it has now surprisingly been found that fouling of tubes by refinery or petrochemical process streams, operating at the usual refinery range of conditions, is remarkably reduced by introducing into the stream, as antifoulant additive, appropriate amounts of specific organic aluminium salts, namely aluminium stearate or aluminium acetate.

The use of aluminium stearate or aluminium acetate as antifoulant additive for refinery and petrochemical process streams has been found to be particularly applicable to situations where the streams are subject to high temperatures. Thus under these conditions not only is the fouling problem at a maximum, but the efficiency of known organic antifoulants is at a minimum. The aluminium stearate or acetate is therefore preferably used in process streams subjected to temperatures of from 400° to 600° C., more preferably 450° to 550° C. However the materials have also been found to be effective at much higher temperatures, for example up to 800° C.

and above, temperatures such as 750° to 850° C. being typical of some modern steam cracker operations. The additives have been found to be particularly useful as antifoulants where the tubes carrying the process stream constitute furnace or heat exchanger tubes, for example in visbreakers, delayed cokers and steam crackers.

By way of example, the aluminium stearate or acetate has been found to be effective when injected into a visbreaker feed which is paraffinic in nature, and also into the bottoms or tar streams emitting from such equipment. The materials also have antifoulant effect in steam cracked tar streams, e.g. those having a proportion of some 65–75% aromatic carbon atoms. Typically such tar streams may be passed through heat exchangers, where fouling becomes a problem.

As is the case with conventional entirely organic antifoulants, the method of the present invention may be carried out by injecting the specified active ingredients on a continuous or intermittent basis at any desired point in the flow path of the stream which is likely to foul the tubes and other equipment through which it passes. Preferably injection is just upstream of susceptible regions such as furnaces or heat exchangers. In use of the method of the invention, the aluminium stearate or acetate is preferably introduced into the process stream in the form of a solution in an organic solvent such as xylene. Preferably such solution contains from 5 to 50 wt % of the active material, more preferably from 10 to 20 wt % thereof, but the proportion can be adjusted to facilitate the injection technique employed, consistent with ensuring that an effective amount of active ingredient is maintained in the stream being so treated.

The amounts necessarily introduced into the streams to give the antifoulant effect may readily be determined in practice, for example by use of a thermal fouling tester of the type described hereinabove. It has been found that treat rates as low as 5 ppm, based on the stream, may be effective to reduce fouling, depending on the temperature and nature of the stream being treated. There is no technical upper limit, although it would be unusual to exceed 50000 ppm and for economic reasons a limit of 1000 ppm is generally appropriate. For usual applications, therefore the treat rate is preferably in the range 50 to 1000 ppm of active material, more preferably 50 to 500 ppm, and the range 75 to 200 ppm is particularly preferred.

It will be understood, of course, that the aluminium salt/solvent combination preferably employed is one which is compatible with the feed stock carried by the tube. Typical feed stocks on which the aluminium stearate and/or acetate addition has been demonstrated to give antifouling effect include atmospheric pipe still residuum. Data from a wide range of visbreaker feeds and tars have shown fouling reductions using the aluminium stearate and acetate salts of from 30 to 100%, compared with the fouling of the corresponding streams without added antifoulant, or with the addition of conventional antifoulants.

The following Examples illustrate the invention.

EXAMPLES

Using a thermal fouling tester as described hereinbefore, fouling of two typical refinery process streams was measured. The streams comprised (a) the atmospheric residue feed of a typical refinery visbreaker; and (b) the tar bottoms produced by the visbreaker which normally would be directed to fuel oil blending. The fouling characteristics of the feed and tar are shown in Table 1.

To perform the fouling measurement, the tester was operated at a constant stream outlet temperature of 365° C., corresponding to an initial heater tube temperature in the range 515° to 535° C. The runs were each continued for a period of 3 hours, and fouling was measured in terms of the heater tube temperature increase necessary to maintain constant outlet temperature. For the visbreaker feed stream, the required tube temperature increase was about 20 deg C; for the visbreaker tar stream the increase was about 60 deg C, which indicates a substantially greater fouling effect of the tar.

For comparison purposes, further runs were conducted wherein a selection of conventional wholly organic antifoulants, usually used in lower temperature refinery operations, was introduced into the streams at various treat rates ranging from 50 to 200 ppm, and again at initial tube temperatures of 515° to 535° C.

The conventional antifoulants used in the comparison runs were as follows:

A—organic amine-based dispersant/antioxidant composition

B—organic amide-based dispersant, low actives composition

C—active ingredient as B, but with higher actives content

D—organic antioxidant composition

E—amine-based filming inhibitor composition

F—antipolymerant composition

The antifouling activity of aluminium stearate and aluminium acetate was tested on the same streams by introducing into the feed or tar a 20 wt % xylene solution of the additive. Mixing was at 100° C., and thereafter the streams were passed through the tester as for the streams containing additives A–F.

The results of the tests are shown in Table 2 in which the effectiveness of the particular antifoulant treatment employed is presented as a % reduction (or increase) in the fouling which occurs when using the antifoulant, compared with the fouling caused by the same stream subjected to identical conditions but without added antifoulant. The fouling of the additive free stream is measured, as explained hereinbefore, in terms of the heater tube temperature which is necessary (after 3 hours) to maintain the tester output stream at a constant (fixed) temperature. The difference between the initial required heater tube temperature and the temperature required after 3 hours is then compared with the corresponding temperature differences obtained for the stream which contains antifoulant. The fouling is presented as the untreated stream temperature delta minus the antifoulant-containing stream temperature delta, expressed as a percentage of the temperature delta measured for the untreated stream. Each test result reported in the table is an average of several specific runs. From Table 2 it may be seen that aluminium stearate in treat rates of 100 and 500 ppm gave identical fouling reductions of 36% in the visbreaker feed, and a treat rate of 500 ppm gave an average 38% fouling reduction for the visbreaker tar stream. An aluminium acetate injection at 100 ppm gave a 41% fouling reduction for the feed stream.

A test of xylene alone showed no significant change in fouling, indicating that it is the aluminium stearate and acetate which has the antifouling effect. As may be seen from Table 2, additives A–F showed either no impact on the fouling which was taking place, or in some cases actually increased the fouling that occurred, in some instances by 50 to 100%. The increased fouling was quite noticeable with the visbreaker feed stream, but less so with the tar stream. For the purposes of these tests, so as to allow for experimental error and the fact that the tester employed cannot completely reproduce refinery operating conditions, results showing less than 20% decrease in fouling, compared with the untreated streams, are considered to have no antifouling effect.

TABLE 1

| Visbreaker stream fouling characteristics | Feed | Tar |
|---|---|---|
| Conradson Carbon (wt %) | 13.8 | 16.3 |
| Asphaltenes (wt %) | 2.4 | 8.2 |
| Toluene Insolubles (wt %) | 0.1 | 0.1 |
| Salt (ppm) | 48 | 73 |

TABLE 2

| Additive | Treat Rate (ppm) | Fouling Reduction (%) |
|---|---|---|
| | Visbreaker Feed | |
| None | 0 | 0 |
| Aluminium stearate | 100 | 36 |
| Aluminium acetate | 100 | 41 |
| Aluminium stearate | 500 | 36 |
| A | 200 | (90) |
| B | 200 | (45) |
| C | 200 | (50) |
| C | 50 | (23) |
| | Visbreaker Tar | |
| None | 0 | 0 |
| Aluminium stearate | 500 | 39 |
| Aluminium stearate | 500 | 37 |
| C | 100 | (16) |
| D | 100 | (2) |
| E | 100 | 18 |
| F | 100 | (3) |

Values in ( ) indicate an increase in fouling.

We claim:

1. A method of reducing fouling in a tube carrying a refinery or petrochemical process stream which comprises introducing into the stream an effective concentration of an antifoulant selected from the group consisting of at least one of aluminium stearate and aluminium acetate.

2. A method according to claim 1, wherein the stream is carried through the tube at elevated temperature.

3. A method according to claim 2, wherein the stream temperature is from 750° to 850° C.

4. A method according to claim 2, wherein the stream temperature is from 400° to 600° C.

5. A method according to claim 1, wherein the stream temperature is from 450° to 550° C.

6. A method according to claim 1 wherein the antifoulant is introduced in the form of a solution in an organic solvent.

7. A method according to claim 6, wherein the organic solvent is xylene.

8. A method according to claim 6, wherein the solution comprises from 5 to 50 wt % of antifoulant.

9. A method according to claim 8 wherein the solution comprises from 10 to 20 wt % of antifoulant.

10. A method according to claim 1 wherein the concentration of antifoulant in the stream is from 5 to 50000 ppm.

11. A method according to claim 10 wherein the concentration is from 50 to 1000 ppm.

12. A method according to claim 11, wherein the concentration is from 50 to 500 ppm.

13. A method according to claim 12, wherein the concentration is from 75 to 200 ppm.

14. A method according to claim 1 wherein the tube is selected from furnace and heat exchanger tube.

15. A method according to claim 1 wherein the tube comprises a component of plant equipment selected from visbreakers, delayed cokers and steam crackers.

16. A method according to claim 1 wherein the process stream is selected from the group consisting of visbreaker feeds, visbreaker tars, steam cracker feeds and steam cracked tars.

17. A method according to claim 1 wherein the refinery process stream is selected from the group consisting of atmospheric pipe still residuum, catalytic cracker residuum and vacuum distillation residuum.

18. The use of substances selected from aluminium stearate, aluminium acetate and compositions comprising at least one of said stearate and acetate, as antifouling additives for refinery or petrochemical process streams.

* * * * *